US008371003B2

(12) United States Patent
Arney et al.

(10) Patent No.: US 8,371,003 B2
(45) Date of Patent: Feb. 12, 2013

(54) DEVICE FOR OPENING AND CLOSING A ZIPPER

(75) Inventors: Jeffrey Scott Arney, Hickory, NC (US); Serge Levine, Hickory, NC (US)

(73) Assignee: BSN Medical, Inc., Charlotte, NC (US)

( * ) Notice: Subject to any disclaimer, the term of this patent is extended or adjusted under 35 U.S.C. 154(b) by 257 days.

(21) Appl. No.: 12/478,224

(22) Filed: Jun. 4, 2009

(65) Prior Publication Data

US 2010/0306971 A1 Dec. 9, 2010

(51) Int. Cl.
*A44B 19/00* (2006.01)

(52) U.S. Cl. ..... 24/429; 24/427; 24/430; 294/3.6

(58) Field of Classification Search ..... 24/427, 24/429, 430; 294/1.1, 3.6, 25, 26; 223/1, 223/111; 2/96, 239, 336
See application file for complete search history.

(56) References Cited

U.S. PATENT DOCUMENTS

| | | | | |
|---|---|---|---|---|
| 2,178,885 | A | 11/1939 | Buff et al. | |
| 2,483,057 | A | 9/1949 | Levering | |
| 2,626,440 | A | 1/1953 | Carlile | |
| 2,887,751 | A * | 5/1959 | Lamb | 294/3.6 |
| 2,900,205 | A * | 8/1959 | Cirone | 294/3.6 |
| 2,939,193 | A | 6/1960 | Morgan | |
| 3,006,051 | A * | 10/1961 | Maeder | 294/3.6 |
| 3,145,041 | A | 8/1964 | Grolig | |
| 3,284,865 | A | 11/1966 | Burnham | |
| 3,836,189 | A * | 9/1974 | Borrelli | 294/3.6 |
| 4,022,506 | A * | 5/1977 | Cloud, Sr. | 294/3.6 |
| 4,350,375 | A | 9/1982 | Bako | |
| 4,757,577 | A | 7/1988 | Freeman | |
| 4,976,120 | A * | 12/1990 | Terada et al. | 70/68 |
| 5,975,386 | A | 11/1999 | Fernicola | |
| 6,510,593 | B1 * | 1/2003 | Kim | 24/418 |
| 7,024,701 | B2 * | 4/2006 | Marty et al. | 2/96 |
| 7,039,989 | B2 | 5/2006 | Marty | |
| 7,043,802 | B2 * | 5/2006 | Moeller et al. | 24/429 |
| 7,073,233 | B2 * | 7/2006 | Leva et al. | 24/386 |

OTHER PUBLICATIONS

International Search Report dated Jul. 20, 2009 for PCT/US2009/046554.
International Search Report dated Apr. 29, 2009 for PCT/US2009/036655.

* cited by examiner

*Primary Examiner* — Robert J Sandy
*Assistant Examiner* — David Upchurch
(74) *Attorney, Agent, or Firm* — Shumaker, Loop & Kendrick, LLP

(57) ABSTRACT

A device for assisting in opening and closing a zipper is provided. The device includes a body having first and second diverging guide channels having mutually oriented guide angles for receiving the respective zipper tracks for sliding, non-interlocking movement of the zipper tracks through the guide channels in advance of the zipper slider for reducing the closure angle of the zipper tracks in advance of the zipper slider to correspond to the guide angle of the guide channels, and a handle carried by the body for permitting manual pulling movement of the body along at least a portion of the length of the zipper and generally positioned in a coextensive orientation in relation to a pull tab of the zipper slider such that an operator can simultaneously grasp the pull tab of the zipper slider and the handle while sliding the zipper slider in the closing direction.

17 Claims, 13 Drawing Sheets

DEVICE FOR OPENING AND CLOSING A ZIPPER

TECHNICAL FIELD AND BACKGROUND OF THE INVENTION

This invention relates to a device for opening and closing a zipper, and more particularly to a zipper opening and closing device adapted for being attached to a zipper of a compression hose and permitting manual pulling movement of the device to pull the zipper in a closing direction.

Zippers are used on virtually all types of garments as a means of easily enabling a garment to be donned, and then secured around the body. In many cases, the zipper may be used to close an opening in a garment that has a relatively loose fit, so that the zipper slider is easily moved up and down the opening, as needed. In other types of garments, the opening may be such as to require more force on the zipper, particularly at the initial, open, zipper position. These garment types include garments such as boots, jackets, purses, backpacks and certain hosiery products.

The particular disclosure and preferred embodiment of the invention as set out in this application relates to compression hose of the type commonly worn to increase blood circulation, usually in a patient's leg. However, the invention is not limited to compression hose, but to any garment or product where assistance in closing a zipper is necessary or desirable. Compression hose function in the required therapeutic manner by tightly fitting around the patient's leg, thereby increasing the blood flow velocity and preventing or reducing blood pooling in the lower extremities. For this reason, compression hose are often fabricated as a shaped elastic panel with a marginal zipper that must be closed to cause the hose to compressively encircle the limb. Because of the need to apply compression to the limb, zippers on these types of garments are often difficult to close because of tight fit of the garment. In many instances the wearer must have assistance from another person, with one person using both hands to hold the opposing side edges of the elastic panel near each other while the other person pulls the zipper along the length of the side edge to encircle the hose around the leg.

In some instances, the zipping forces on the garment are such that significant stresses are placed on the zipper components because as the zipper closing angle increases, progressively greater lateral stresses are imposed on the zipper tracks as the zipper slider is being moved in a zipper-closing direction. In some cases, the stresses can be so large that the zipper cannot be closed past a certain position. In other instances the zipper may be damaged or the zipper slider may separate from the one or both of the zipper tracks during closing. A tool such as a pair of pliers or an elongate hook to engage the zipper slider can be used for facilitating movement of the zipper by allowing even greater force to be applied to the zipper. This increased force may increase the likelihood of damage to the zipper because these tools can apply substantially greater force to the zipper components but do not reduce but merely attempt to overcome the resistance to closing caused by the zipper closing angle.

Accordingly, a need exists for a device for assisting to move a slider of a zipper that is able to maintain the zipper track at an angle sufficiently acute to allow relatively easy manual movement of the zipper slider while avoiding damage to the zipper.

SUMMARY OF THE INVENTION

Therefore, it is an object of the invention to provide a zipper assist device for assisting the opening and closing of a zipper.

It is another object of the invention to provide a zipper assist device that reduces the zipper closing angle, thereby reducing stresses on the zipper.

It is another object of the invention to provide a zipper assist device that is easily installed on a garment or product to be zipped closed, and then removed.

It is another object of the invention to provide a zipper assist device that has sufficient adaptability to fit zippers of varying sizes.

It is another object of the invention to provide a zipper assist device that is portable.

It is another object of the invention to provide a zipper assist device that is detachable from the zipper.

It is another object of the invention to provide a zipper assist device that permits the wearer to don the garment without the assistance of another person.

It is another object of the invention to provide a zipper assist device that reduces the forces needed to efficiently close the zipper.

These and other objects and advantages are achieved by providing a device for assisting in opening and closing a zipper of the type having a zipper slider that opens and closes the zipper by selectively disconnecting and connecting a pair of opposed interlockable zipper tracks as the zipper slider moves in respective opening and closing directions along the zipper tracks. The device includes a body having first and second diverging guide channels having mutually oriented guide angles for receiving the respective zipper tracks for sliding, non-interlocking movement of the zipper tracks along the guide channels in advance of the zipper slider for reducing the closure angle of the zipper tracks in advance of the zipper slider to correspond to the guide angle of the guide channels. A handle is carried by the body for permitting manual pulling movement of the body through at least a portion of the length of the zipper. The handle is generally positioned in a coextensive orientation in relation to a pull tab of the zipper slider such that an operator can simultaneously grasp the pull tab of the zipper slider and the handle while sliding the zipper slider in the closing direction.

According to another embodiment, the body is wedge shaped. According to another embodiment, the first and second diverging guide channels define respective concave surfaces with respect to a centerline of the body.

According to another embodiment, the body includes an opening that receives the handle carried by the body.

According to another embodiment, each guide channel further includes relatively narrow access slots formed in a periphery of each guide channel for receiving and retaining each zipper track within the guide channel.

According to another embodiment, the body further includes an alignment plate positioned at an interlocking point of the zipper slider for providing sliding support to the zipper during pulling movement of the body for assisting and maintaining the device in alignment with the zipper track.

According to another embodiment, each guide channel further includes a bevel at an end of each guide channel for providing ease of ingress and egress of each zipper track.

According to another embodiment, the body includes a notch having a shape that approximates the shape of the zipper slider for receiving the zipper slider therein.

According to another embodiment, the notch is formed proximal the access plate.

According to another embodiment, the device includes a zipper pull tab extension member generally overlapping with the handle and attached to the zipper pull tab.

According to another embodiment, the device includes an arcuately shaped recess defined on a surface opposite the notch for providing clearance for slideable movement about a patient's limb.

According to another preferred embodiment, a device for assisting in opening and closing a zipper of the type having the zipper slider that opens and closes a zipper by selectively disconnecting and connecting a pair of opposed interlockable zipper tracks as the zipper slider moves in respective opening and closing directions through the zipper tracks is provided. The device includes a body having first and second diverging guide channels for receiving the respective zipper tracks for sliding, non-interlocking movement of the zipper tracks along the guide channels in advance of the zipper slider for reducing the closure angle of the zipper tracks in advance of the zipper slider. A handle is carried by the body for permitting manual pulling movement of the body along at least a portion of the length of the zipper. A notch is formed in the body that approximates the shape of the zipper slider for receiving the zipper slider. The handle is generally positioned in a coextensive orientation in relation to a pull tab of the zipper slider such that an operator can simultaneously grasp the pull tab of the zipper slider and the handle while sliding the zipper slider in the closing direction.

According to another preferred embodiment, a method is provided for assisting in closing a zipper of the type having a zipper slider for closing and opening the zipper by selectively disconnecting and connecting a pair of opposed interlockable tracks as the zipper slider moves in respective closing and opening directions through the tracks. The method includes the steps of providing a device including a body having first and second diverging guide channels for receiving the respective zipper tracks for sliding, non-interlocking movement along the guide channel in advance of the central zipper slider selectively connecting the pairs of interlockable tracks for reducing the closure angle of the zipper tracks in advance of the zipper slider. A handle is carried by the body for permitting manual pulling movement of the body, inserting each track into a respective one of the guide channels. The device is slid to a position proximal the zipper slider, and the handle carried by the body and the pull tab of the zipper slider is graspeed and moved by manual operation of the handle along the zipper tracks to close the zipper.

According to another embodiment, the step of inserting each track into a respective guide channel is performed simultaneously.

According to another embodiment, the step of inserting each track into a respective guide channel is performed sequentially.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENTS AND BEST MODE

Figure 1:
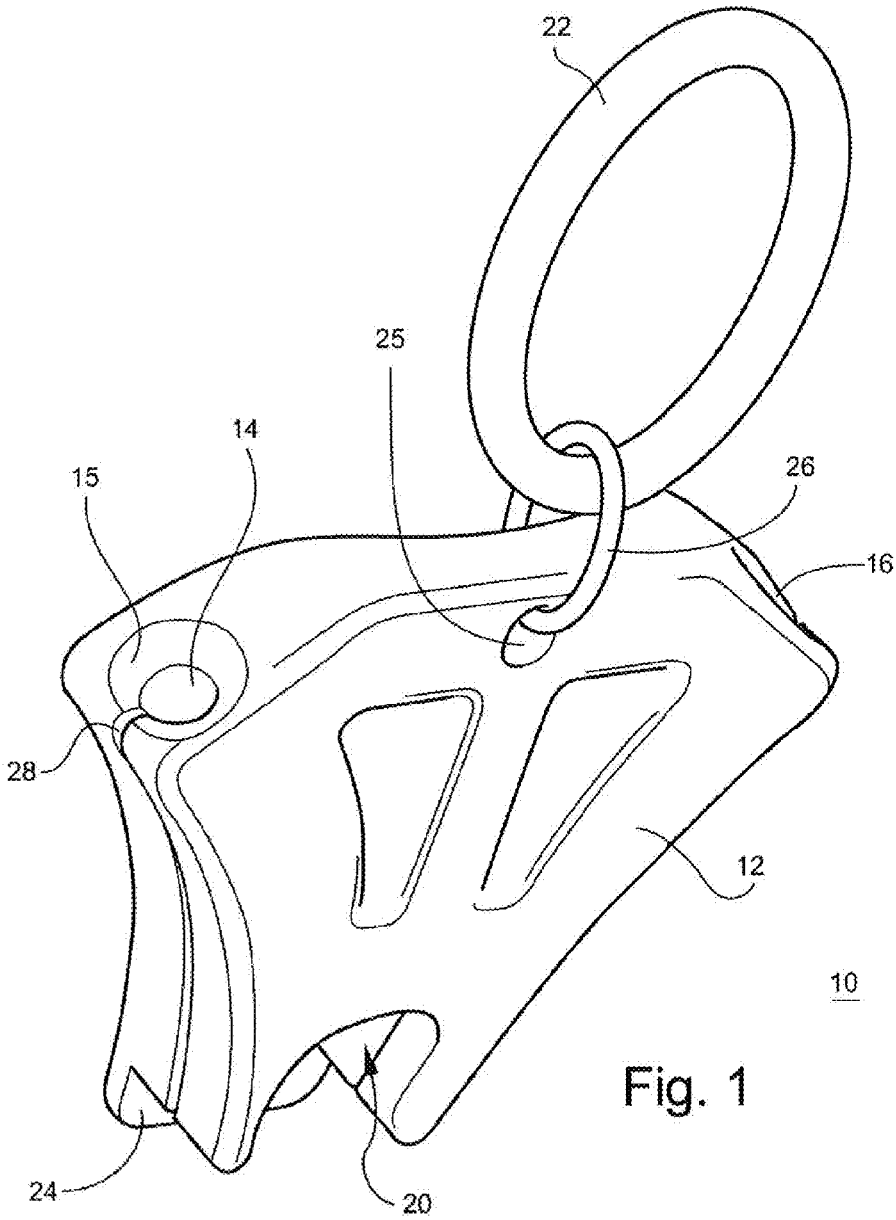
FIG. 1 is a perspective view of a device for assisting in zipping a zipper according to one embodiment of the invention.
Figure 3:
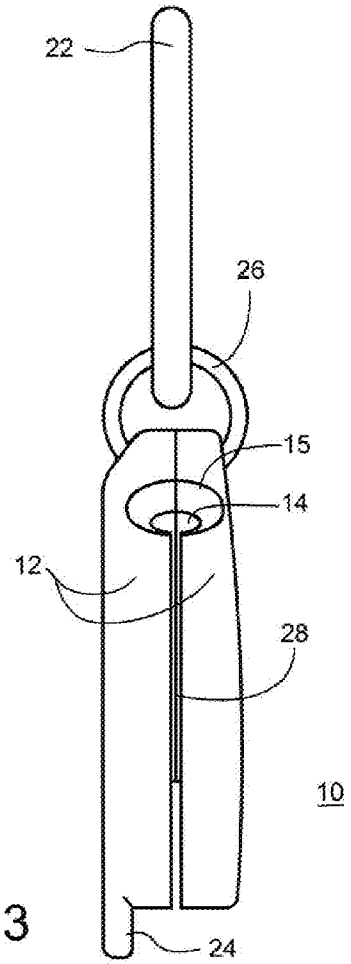
FIG. 3 is a side view of the zipper assist device.
Figure 2:
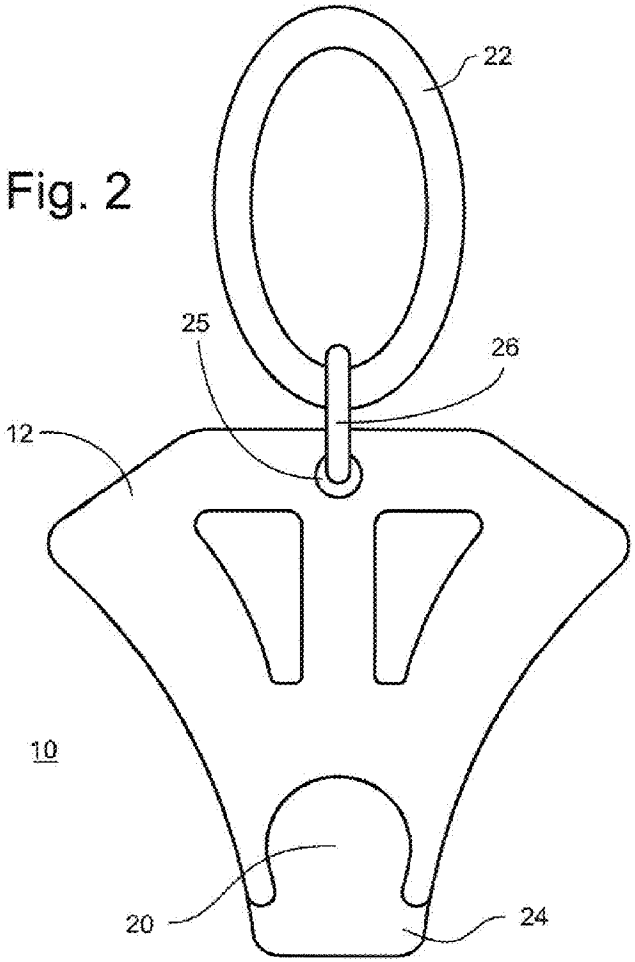
FIG. 2 is a front view of the zipper assist device.
Figure 5:
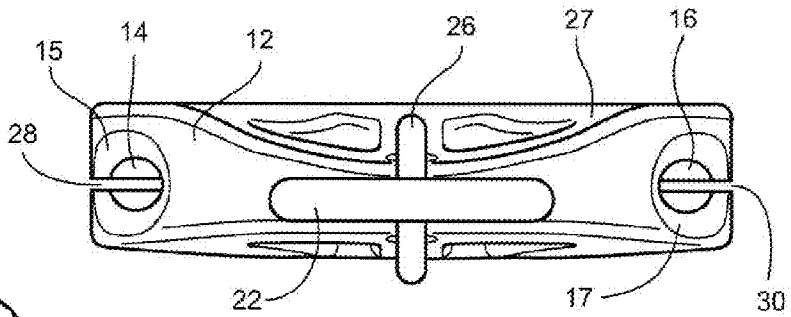
FIG. 5 is a top view of the zipper assist device.
Figure 4:
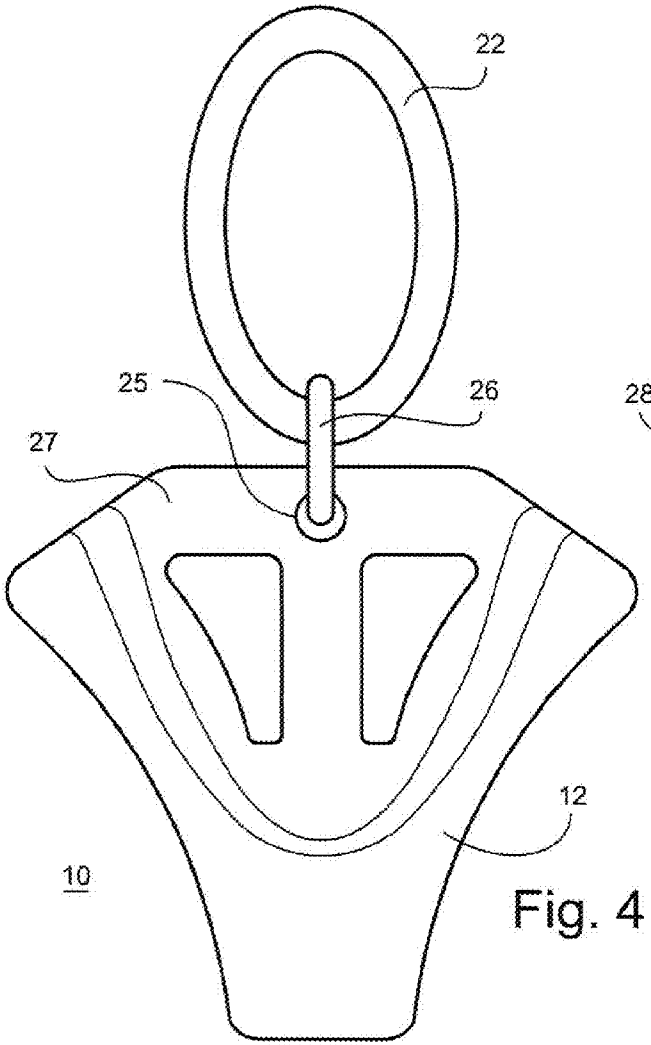
FIG. 4 is a rear view of the zipper assist device.

Referring now specifically to the drawings, a device for assisting in opening and closing a zipper according to the present invention, hereinafter referred to as a "zipper assist device", is shown in FIGS. 1-11 at reference numeral 10. The zipper assist device 10 preferably includes a wedge-shaped body 12 and a pair of guide channels 14, 16 formed on opposing sides of the body 12. A handle 22 in the form of a ring is provided that connects to the body 12 and allows manual operation by inserting one or two fingers through the handle 22 in order to pull the body 12. The body 12 may take any shape that enables the body 12 to draw the tracks 6, 8 sufficiently together to permit easy closure of the zipper 2.

The zipper assist device 10 assists a patient or operator in pulling a zipper 2 along a pair of tracks 6, 8, to close or open a compression hose product 1 as shown in sequential order in FIGS. 6-11. The tracks 6, 8 are typically sewn into the compression hose 1 by stitching. A central slider 4 acts to interlock respective teeth of the pair of tracks 6, 8 to interlock the tracks 6, 8 as needed to operate the zipper 2. The slider 4 includes a tab 5 for pulling the slider 4. The tab 5 includes an opening 5*a*.

As is shown in FIGS. 6-11, the compression hose 1 is tight fitted around the patient's leg to serve its therapeutic purpose, and often requires a substantial pulling force on the zipper 2 to bring the opposing edges of the compression hose 1 together around the leg. This substantial pulling force may cause damage to the zipper 2 or the zipper tracks 6, 8.

The body 12 may be made out of any suitable material including plastic, metal, or any other known material. The body 12 need not be constructed in the identical shape shown in FIG. 1, and will be effective with any shape that has a generally diverging pair of guide channels 14, 16 angled to reduce the angle by which the zipper tracks 6-8 diverge as the zipper 2 is closed. The body 12 may include a pair of voids as shown in FIG. 1. The voids may be provided for ornamental reasons, to save material, or to alter the rigidity of the body 12. The body 12 also includes an alignment plate 24 positioned on the attachment point end of the body 12. A notch 20 is formed in the body 12 and has a shape that approximates that of the zipper slider 4 such that the zipper slider 4 is able to be received within the notch 20. An alignment plate 24 is adapted for sliding underneath and receiving the central slider 4. In this manner, the alignment plate 24 slides underneath the tracks 6, 8, and thereby provides guiding support for the central slider 4.

The handle 22 is connected to the body 12 by a retaining ring 26 that fits within opening 25 formed in the body 12. The retaining ring 26 provides for rotation of the handle 22 so that the wearer can easily gain access to the handle 22 from a variety of angles. In some embodiments, retaining ring 26 may not be required and handle 22 may be attached directly to opening 25 of the body 12. As noted above, the handle 22 is shown in the shape of a ring, but any suitable shape capable of being grasped, or through which one or more fingers may be inserted, is appropriate.

Figure 8:
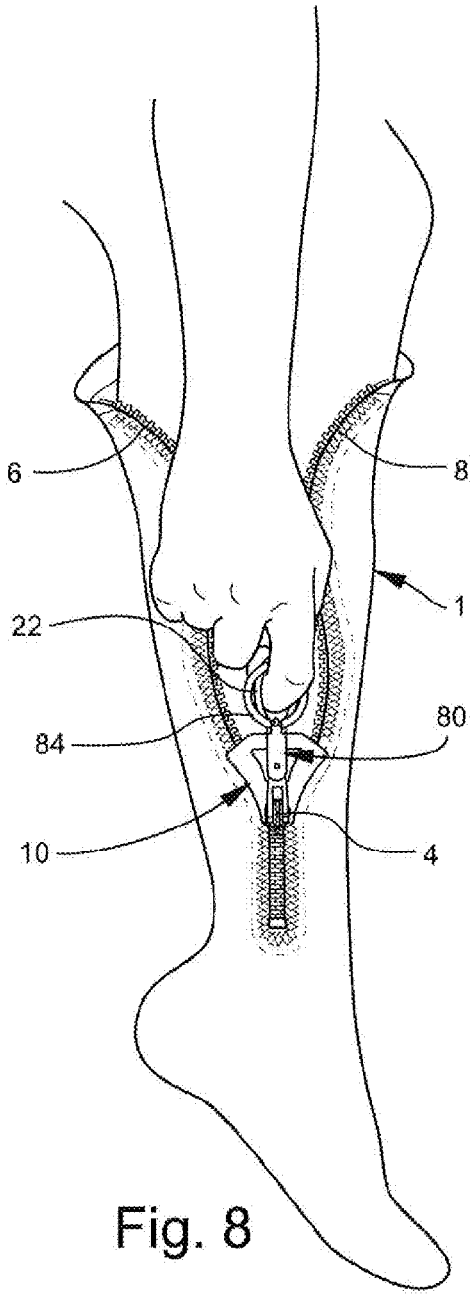
FIG. 8 is a side view of the zipper assist device installed on the zipper track of the compression hose at a lower portion of the zipper track and engaged by a finger of the wearer while being pulled upwards to close the zipper.

The pair of guide channels 14, 16 are positioned on opposing sides of the body 12. Each channel 14, 16 is shown in a generally concave shape in respect to the center of the wedge-shaped body 14, but can be fabricated in other shapes. Each channel 14, 16 is cylindrically shaped to receive the teeth portion of zipper tracks 6, 8. The channels 14, 16 may be made of the same material as the body 12, or may be a different material integrally formed with the body 12. Preferably, each guide channel 14, 16 is made from a durable and low friction material such as metal, but may optionally be made from Delrin®, Teflon®, or any suitable material. Each guide channel 14, 16 also includes a respective access slot 28, 30 extending from each guide channel 14, 16. Access slots 28, 30 receive a respective one of the zipper tracks 6, 8. In this manner the access slots 28, 30 and the guide channels 14, 16 approximate the contour of the zipper tracks 6, 8 and retain the zipper tracks in the guide channels 14, 16. The respective shape of each access slot, 28, 30, and each channel 14, 16, is designed to reduce concentrated stresses and friction by reducing the angle at which the zipper tracks 6, 8 are closed, and providing a gradual transition between their initial angle, such as is shown in FIG. 8. Preferably, the access slots, 28, 30 are also made of a durable and low friction material. Each channel 14, 16, includes a beveled surface 15, 17 at the upper end of each channel 14, 16, respectively, for providing ease of ingress and egress of the zipper tracks 6, 8.

Figure 7A:
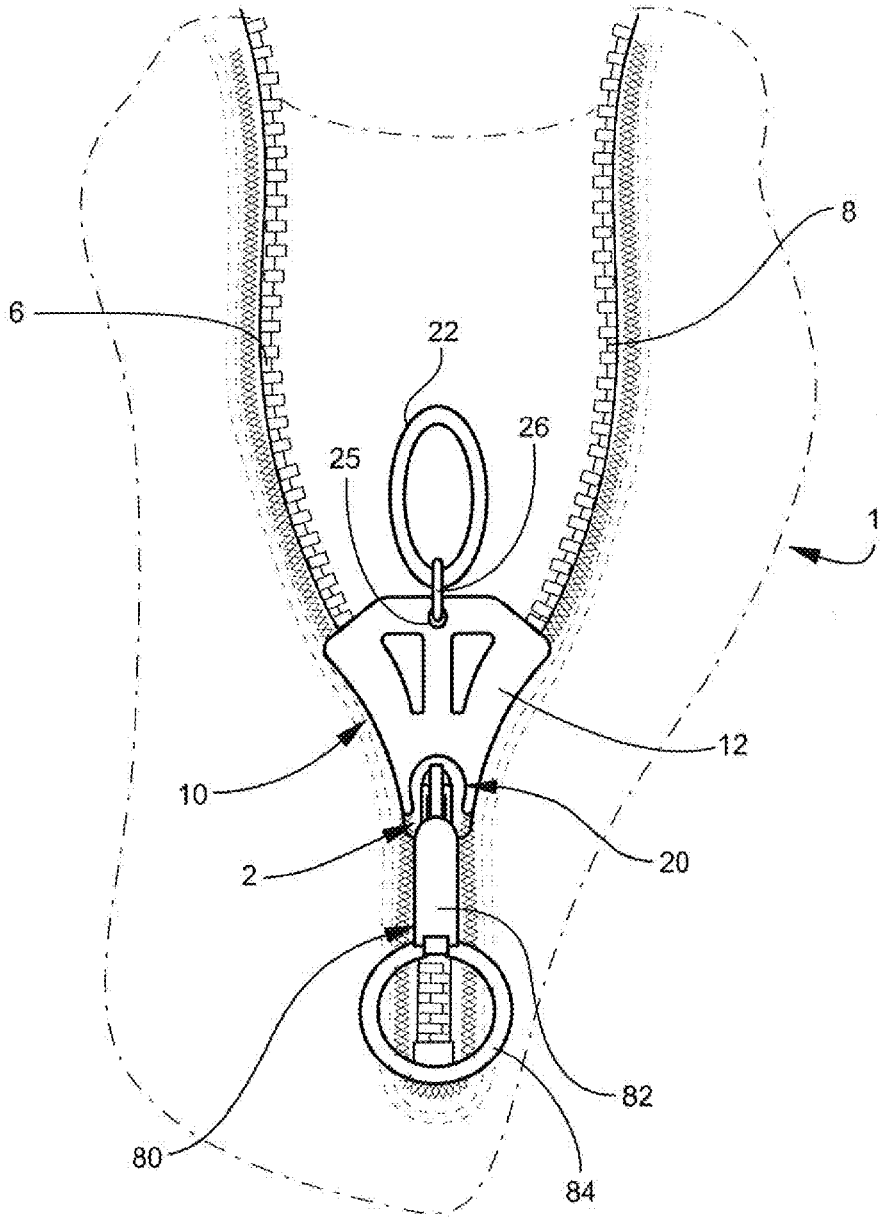
FIG. 7A is a front perspective view of the zipper assist device installed on the zipper track of the compression hose and positioned at the lowest portion of the zipper track.
Figures 7B, 7C:
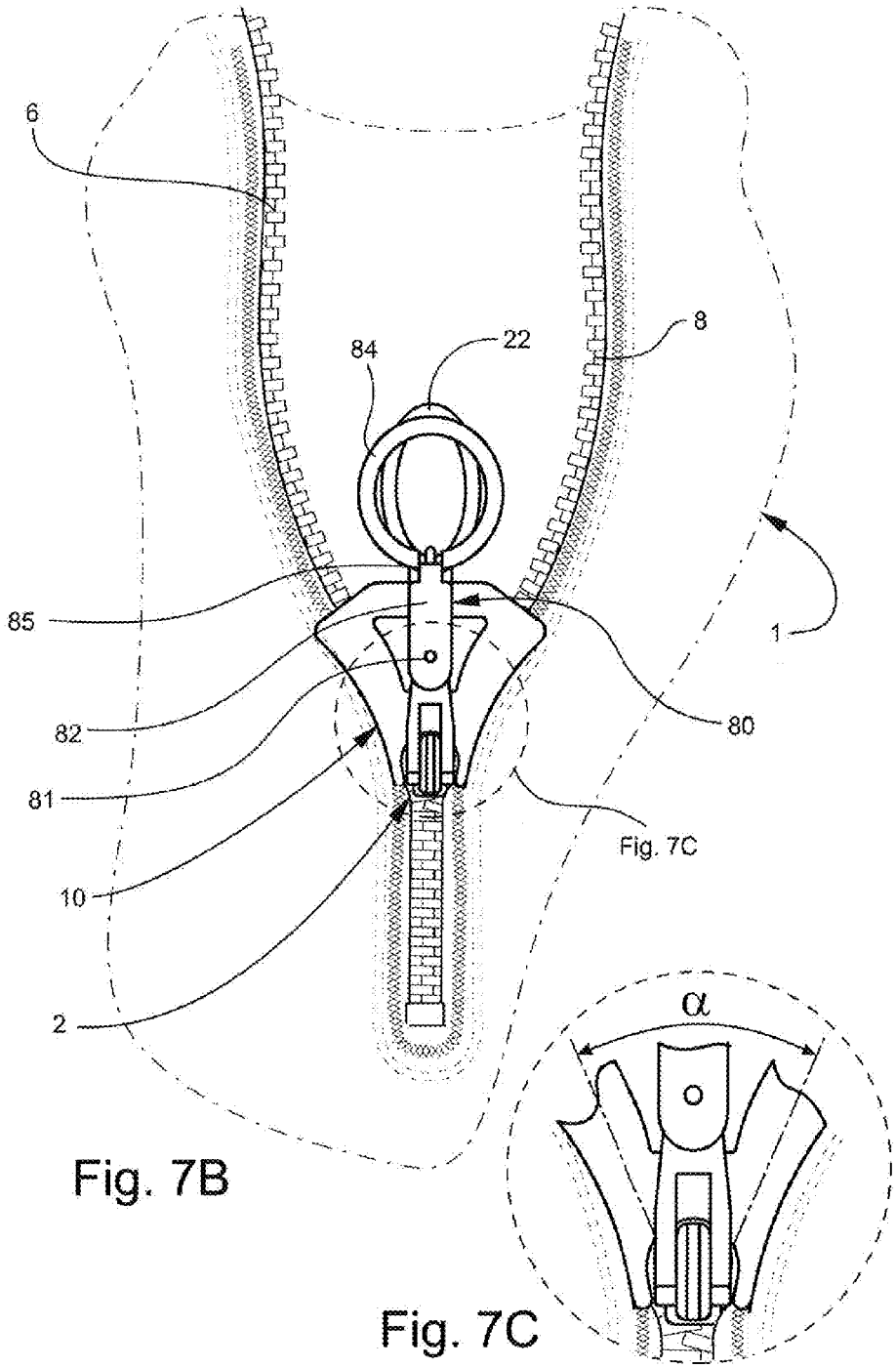
FIG. 7B is a front perspective view of the zipper assist device and the pull tab of the zipper installed on the zipper track of the compression hose and positioned at the lowest portion of the zipper track.
FIG. 7C is an enlarged view of the zipper assist device shown in FIG. 7A.

The wedge shaped body 12 and handle 22 are sized so that the pull tab 5 of the zipper slider 4 is in a generally overlapping and coextensive orientation relative to the handle 22 such that the operator can grasp the handle 22 and the zipper slider pull tab 5 simultaneously, as is shown in, for example, FIG. 7B. The zipper slider pull tab 5 may extend in a generally overlapping or coextensive arrangement with the handle 22, while in other circumstances, it may be appropriate to employ a zipper pull tab extension member 80, shown in FIGS. 12 through 16. The pull tab extension member 80 includes a pair of spaced-apart flanges 82 whose distance is spanned by a post 81 connecting the pair of spaced-apart flanges 82. Post 81 is secured to one of the pair of spaced-apart flanges 82 and is adapted to fit within a corresponding opening formed on the other of the pair of spaced-apart flanges 82. The pair of spaced-apart flanges 82 are generally flexible such that the flange of the pair of spaced-apart flanges 82 that is not attached to the post 81 is bendable to define an opening between the pair of spaced-apart flanges 82 so that the tab opening 5*a* may slide in between the pair of spaced-apart flanges 82 and receive post 81. The flanges 82 are then released and the post 81 is fitted within the corresponding opening formed on the other flange of the pair of spaced-apart flanges 82. The pull tab extension member 80 is then secured to the pull tab 5. A handle 84 that, like handle 22, may be in the form of a ring through which one or two fingers may be inserted, is attached to the pair of spaced-apart flanges 82 and is sized such that it is in a generally overlapping or coextensive position with handle 22 when flipped upwards as shown in the FIG. 7B. In the embodiments shown in FIGS. 11 through 16, handle 84 of the pull tab extension member 80 and handle 22 of the zipper assist device 10 are sized so that the operator's finger will easily fit through both handles 22, 84.

As is shown in FIG. 7C, the zipper assist device 10 operates to reduce the initial angle between the zipper tracks 6, 8 and then maintain a gradual, consistent zipper closing angle $\alpha$ to reduce stresses on the zipper tracks 6, 8. The zipper closing angle $\alpha$ will vary depending on the size of body 12. The pair of guide channels 14, 16 form respective guide angles $\beta$ which collectively form the angle $\alpha$. In preferred embodiments, angle $\alpha$ is preferably about 50 degrees as measured from the topmost portion of the guide channels 14, 16. It shall be appreciated that due to the concave shape of the guide channels 14, 16, the relative zipper closing angle $\alpha$ becomes progressively larger as the zipper tracks 6, 8, travel through the guide channels 14, 16.

An arcuate recess 27 is formed on one surface of the zipper assist device 10 for providing clearance to the limb onto which the garment 1 is being donned. The arcuate recess 27 is formed on the surface opposite the surface having notch 20.

Figure 6:
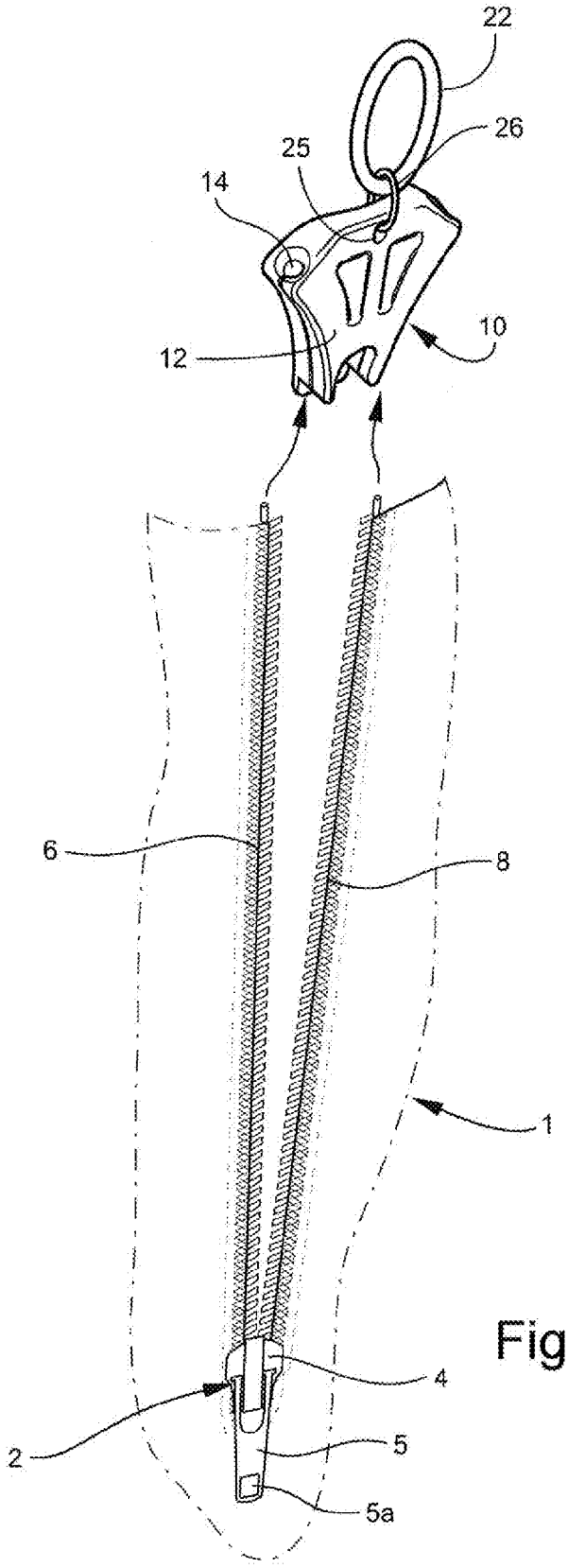
FIG. 6 is a perspective view showing the zipper assist device in position to be installed on a zipper track of a compression hose.

Operation of the zipper assist device 10 on a compression hose 1 is shown according to FIGS. 6 through 11. As shown in FIG. 6, the central slider 4 of the zipper 2 is preferably in its completely unzipped position. The zipper assist device 10 is then positioned proximal the unzipped portion of the zipper tracks 6, 8, which are shown at the most upwardly position in FIG. 6. Each track 6, 8 is positioned proximal to each respective guide channel 14, 16 of the zipper assist device 10. It may be possible to insert both tracks 6, 8 simultaneously into both guide channels 14, 16, but it is assumed that the wearer will preferably insert one track 6 or 8 into its respective guide channel 14 or 16, and then insert the second track 6 or 8 into its respective guide channel 14 or 16. As shown in FIG. 7, the zipper assist device 10 is then slid down the zipper tracks 6, 8 until the zipper assist device 10 is in close proximity to the zipper 2. The alignment plate 24 of the zipper assist device 10 slides underneath the central slider 4 thereby providing increased support for the zipper 2. As shown in FIGS. 6 through 11, zipper pull tab extension member 80 is attached to the tab 5 to extend the zipper pull tab 5 such that the handle 84 of the zipper pull tab extension member 80 is in general overlapping or coextensive alignment with handle 22, if extension of the pull tab 5 is required. In other embodiments, the zipper assist device 80 and pull tab 5 may sized so that the extension member 80 is not required.

Figure 9:
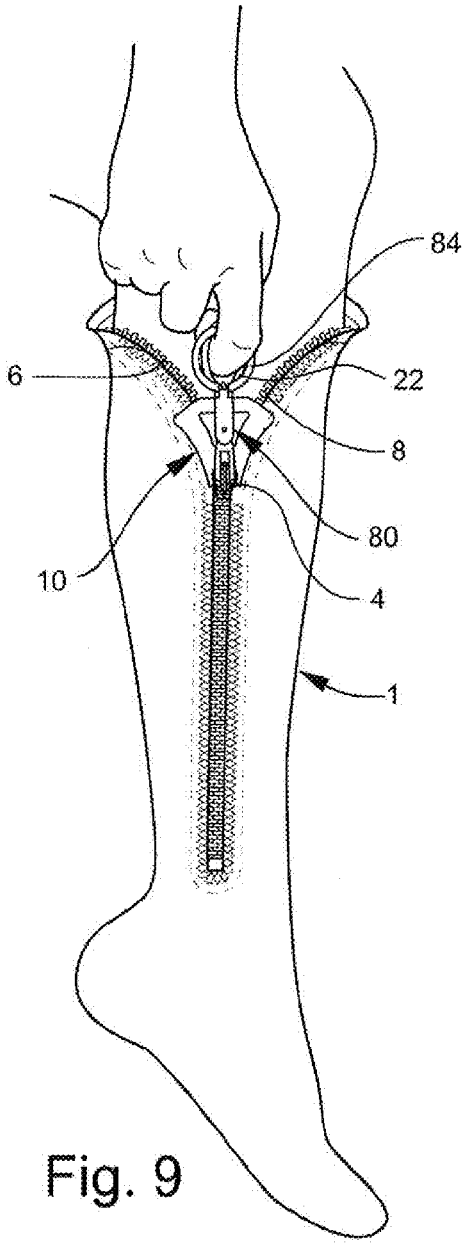
FIG. 9 is a side view, showing the zipper assist device installed on the zipper track of the compression hose at a medial portion of the zipper track and engaged by a finger of the wearer while being pulled upwards to close the zipper.
Figure 10:
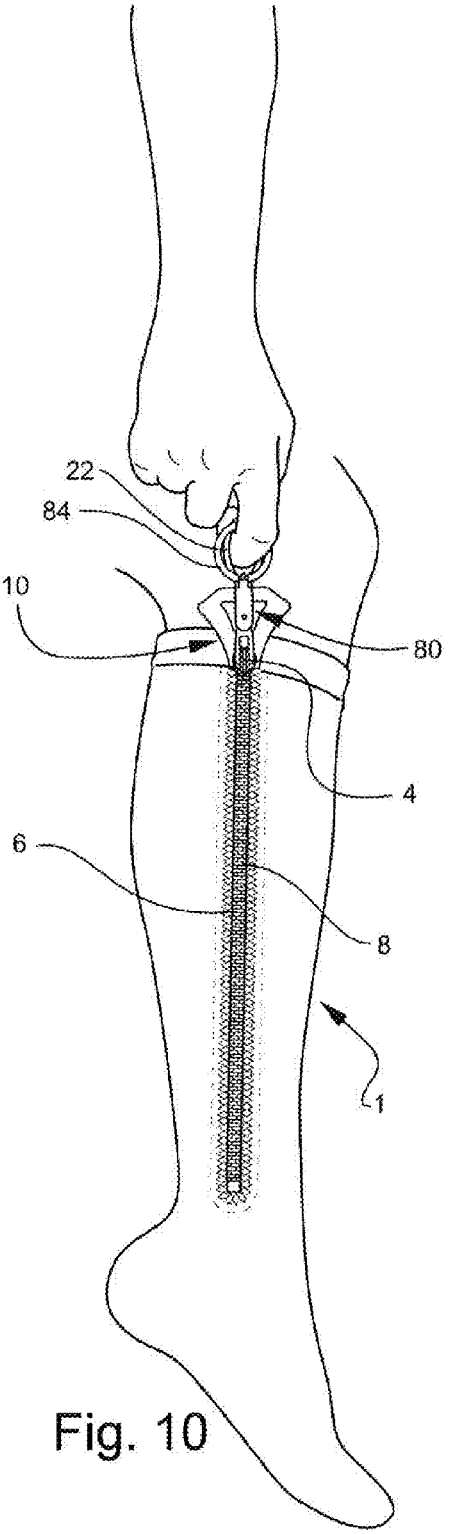
FIG. 10 is a front perspective view, showing the zipper assist device installed on the zipper track of the compression hose at the highest portion of the zipper track and engaged by a finger of the wearer while being pulled upwards to close the zipper.
Figure 11:
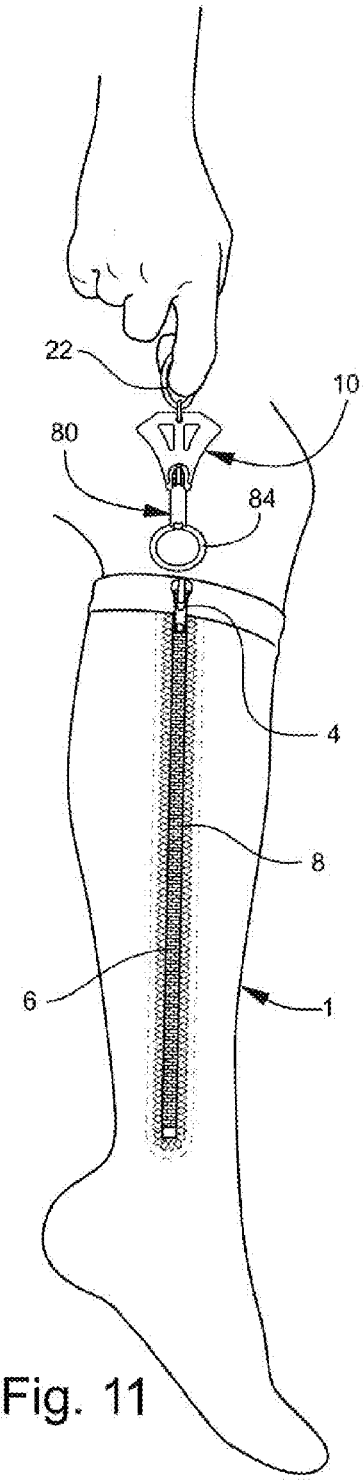
FIG. 11 is a front perspective view, wherein the zipper assist device is no longer installed on the zipper track of the compression hose and the compression hose is fully closed.
Figure 12:
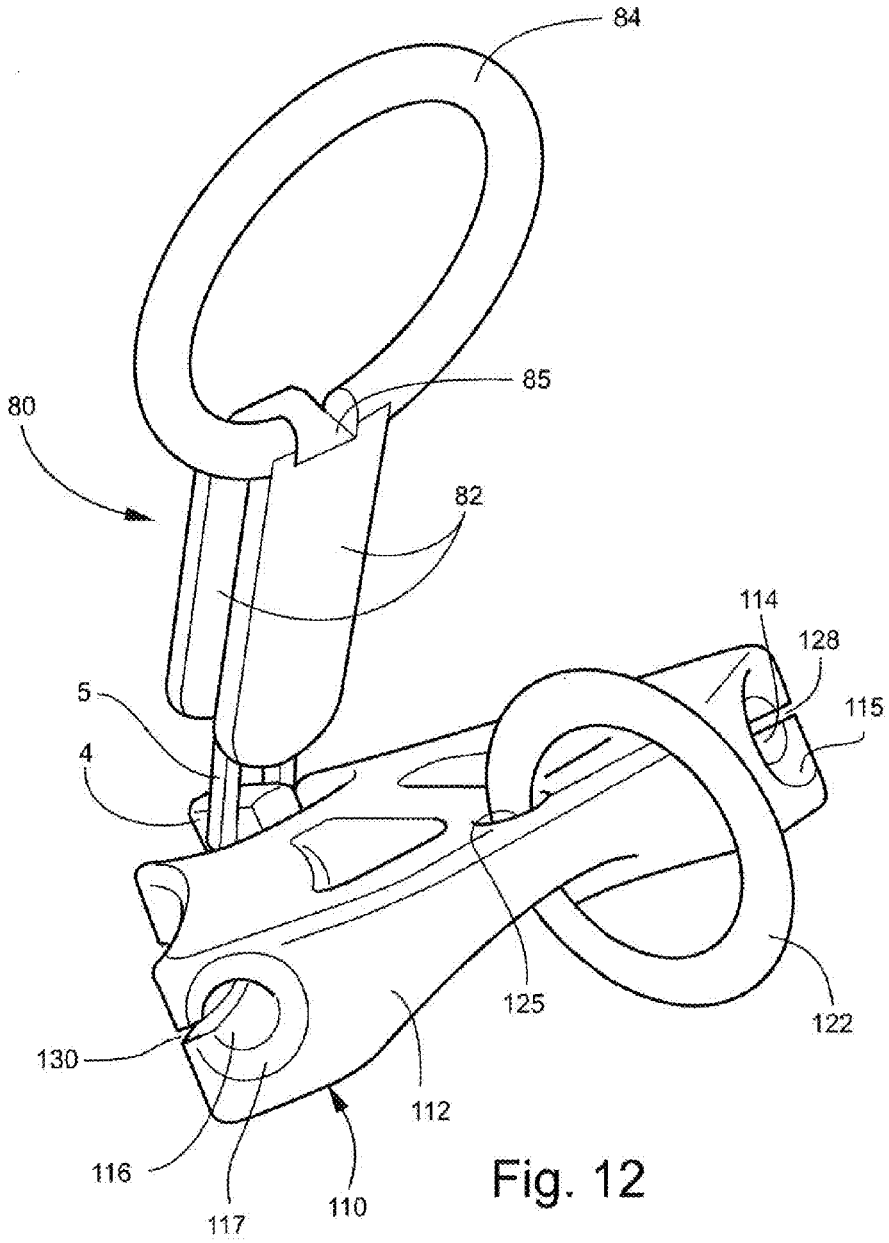
FIG. 12 is a perspective view of a zipper assist device and a zipper pull tab extension member according to an alternate embodiment of the present invention.
Figure 13:
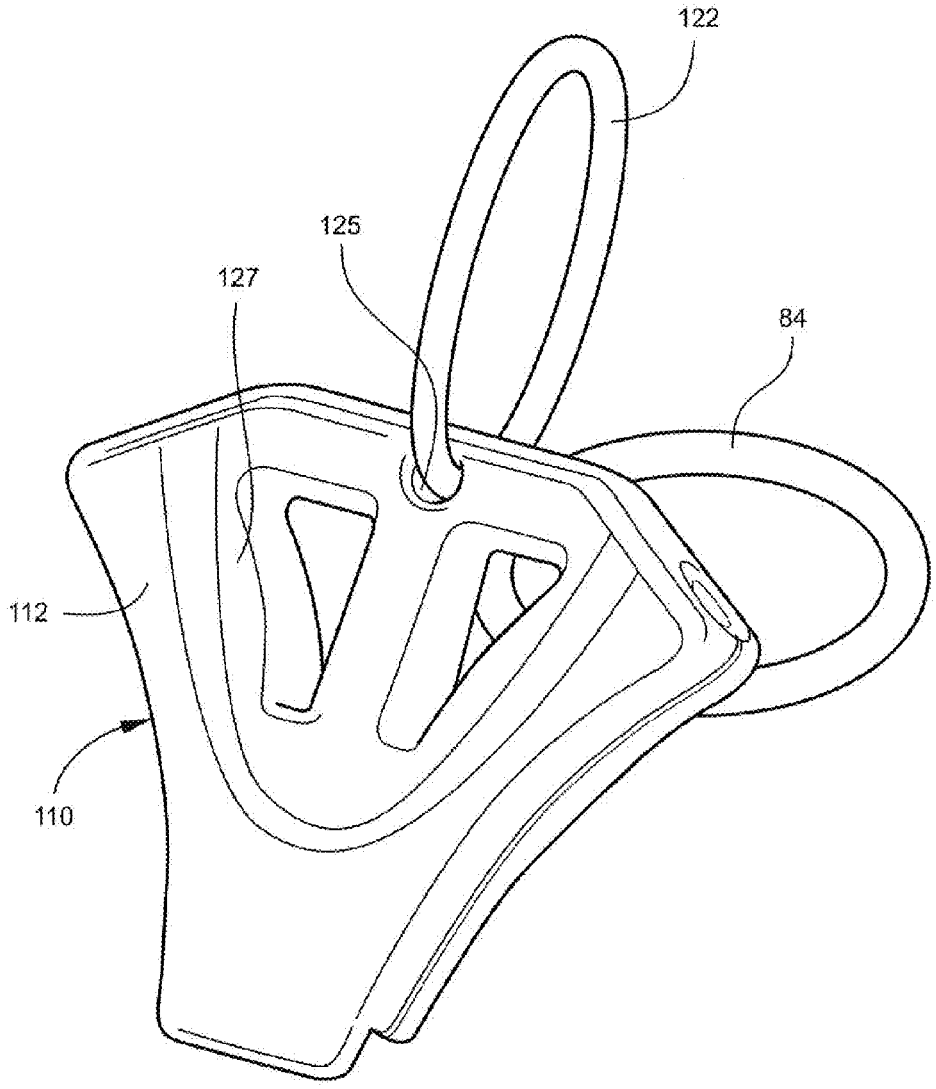
FIG. 13 is another perspective view of a detachable zipper assist device according to the alternate embodiment.
Figure 14:
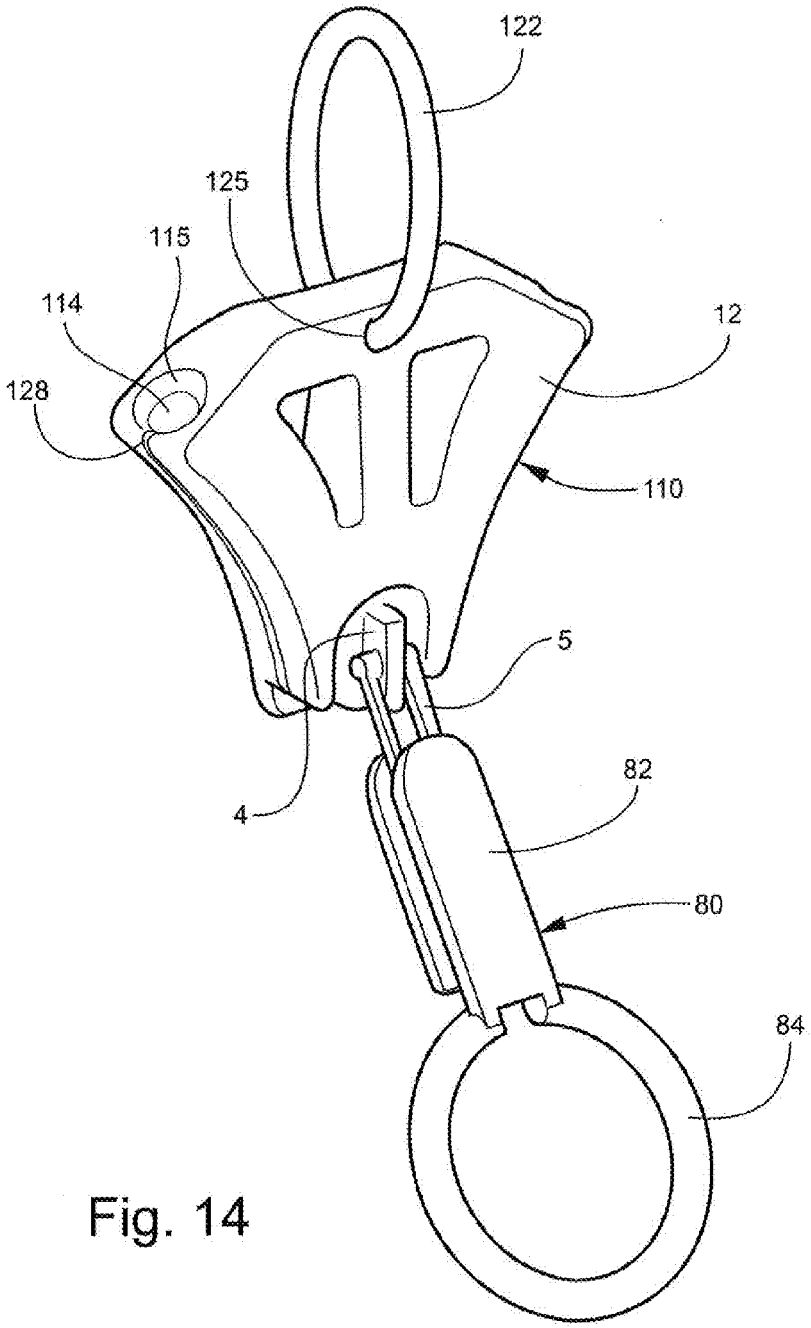
FIG. 14 is another perspective view of the zipper assist device according to the alternate embodiment.
Figure 15:
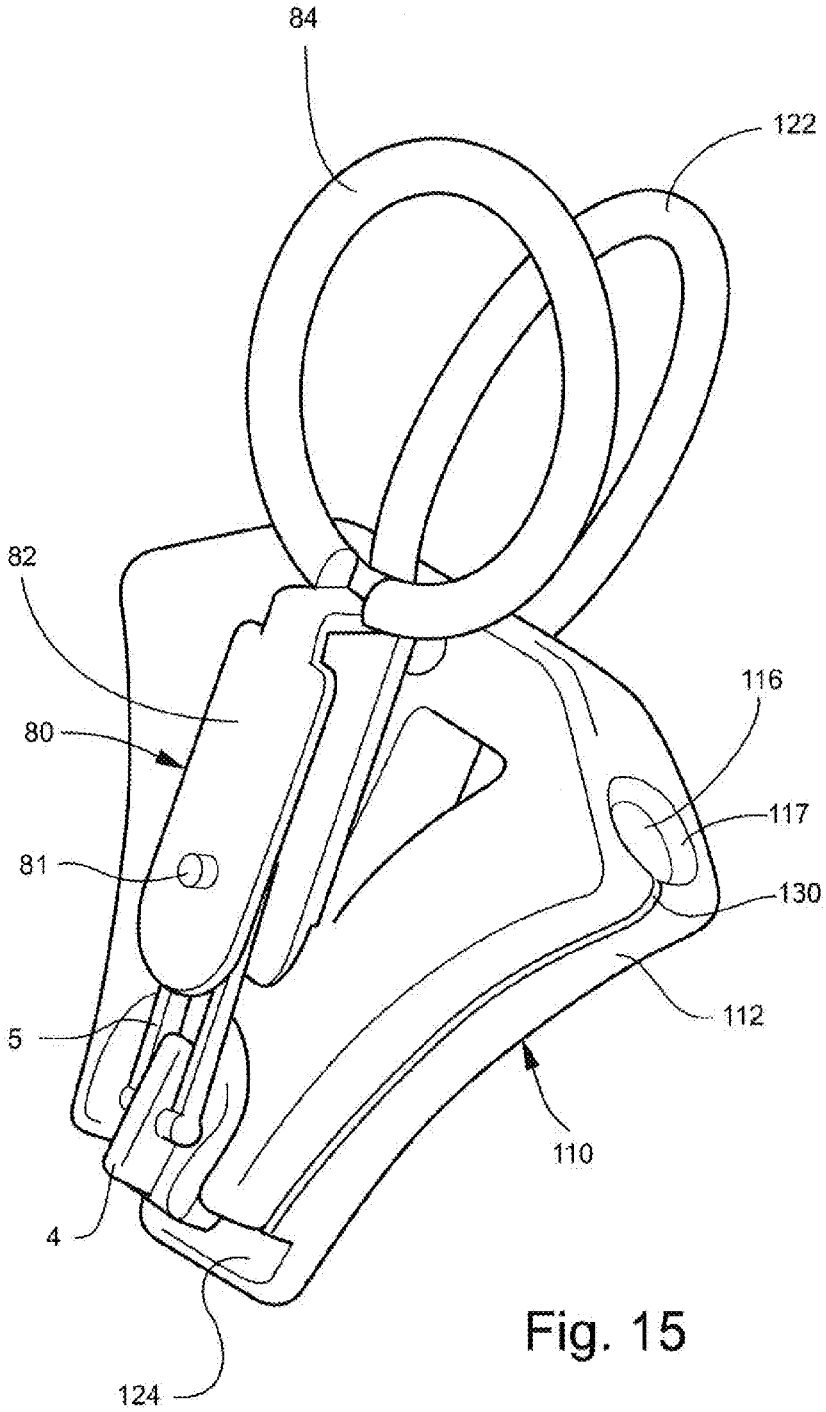
FIG. 15 is another perspective view of the zipper assist device according to the alternate embodiment.
Figure 16:
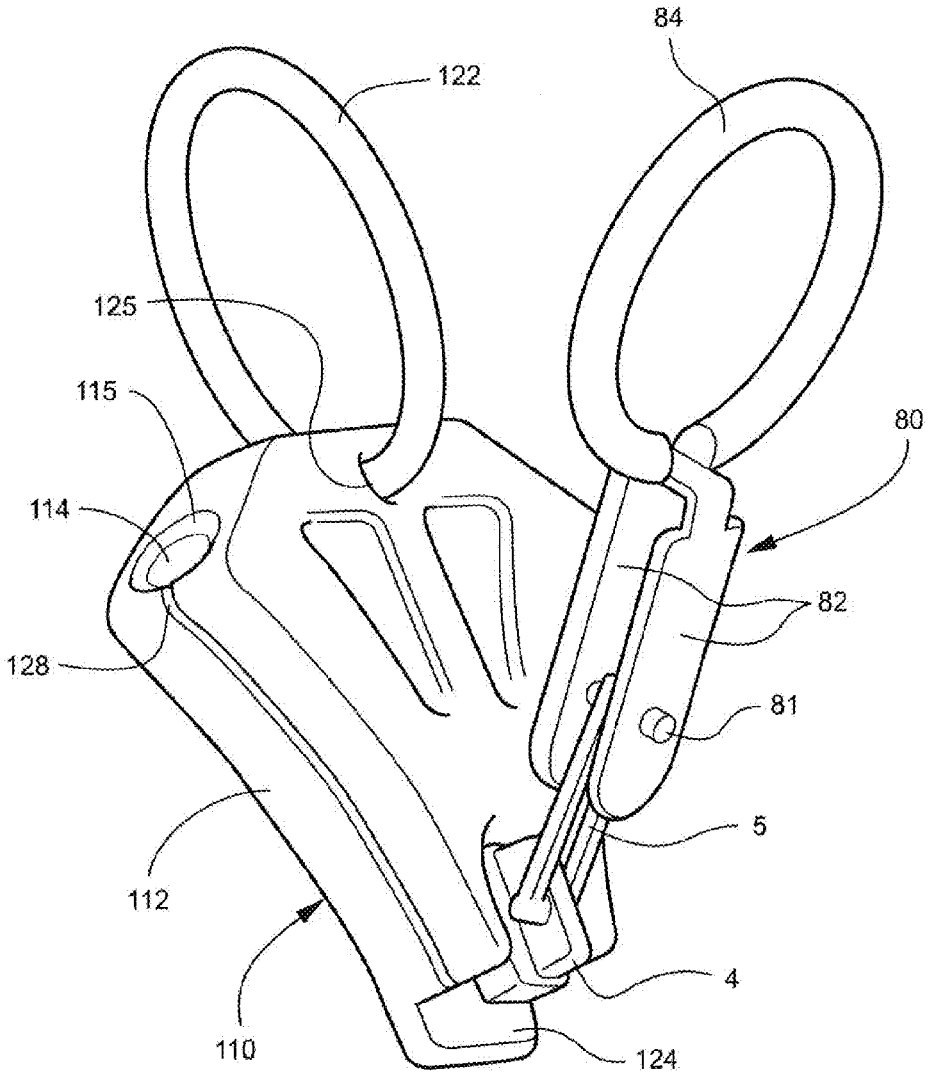
FIG. 16 is another perspective view of the zipper assist device according to the alternate embodiment.

As shown in FIG. 8, once the zipper extension member 80 is positioned in a generally overlapping or coextensive orientation to the zipper assist device 10 such that handle 84 of the extension member 80 and handle 22 of the zipper assist device 10 are generally concentric, the wearer then pulls on the handle 22 of the body 12 and handle 84 of the extension member 80 to move the zipper assist device 10 along the length of the zipper tracks 6, 8, closing zipper 2, as shown sequentially in FIGS. 8, 9, and 10. Once the zipper assist device 10 is at a most upward closed position on the zipper tracks 6, 8, the zipper assist device 10 is then removed from the zipper 2 by releasing the zipper pull tab 5 or the zipper pull tab extension member 80, if used. In this manner, the extension member 80 flips downward as shown in FIG. 11, and the zipper assist device 10 is then pulled away from the garment 1 and the extension member 80.

If the zipper pull tab extension member 80 is used, then it may be removed by completing the steps required for installing the member 80 in reverse order. In other embodiments, the garment 1 may be sold with the zipper pull tab extension member 80 already installed and the extension member 80 may be left attached to the zipper pull tab 5 during use.

An alternate embodiment of the zipper assist device is shown in FIGS. 12 through 16 and is shown at reference numeral 100. The zipper assist device 100 includes a wedge-shaped body 112 and a pair of guide channels 114, 116 formed on opposing sides of the body 112. A handle 122 is provided that interconnects with opening 125 formed in the body 112.

Each guide channel 114, 116 has respective access slots 128, 130. Additionally, each guide channel 114, 116 provides a beveled surface 114, 117 for ease of ingress and egress of the zipper tracks 6, 8. The body 112 includes an alignment plate 124 respectively positioned on the connection end of the body 112. Alignment plate 124 is adapted for sliding underneath and receiving the central slider 4 of the zipper 2. In this manner, the alignment plate 124 acts to slide underneath the tracks 6, 8, providing guiding support for the central slider 4.

A zipper assist device according to several embodiments is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A device for assisting a zipper slider in selectively disconnecting and connecting a pair of opposed interlockable zipper tracks as the zipper slider moves in respective opening and closing directions along the zipper tracks, the device comprising:

(a) a body having first and second diverging guide channels defining respective guide angles for receiving the respective zipper tracks for sliding, non-interlocking guiding movement of the zipper tracks through the guide channels in advance of the zipper slider for reducing a closure angle of the zipper tracks in advance of the zipper slider to correspond to the respective guide angles of the guide channels;

(b) a handle carried by the body for permitting manual pulling movement of the body along at least a portion of the length of the zipper and generally positioned in a coextensive orientation in relation to a pull tab of the zipper slider such that an operator can simultaneously grasp the pull tab of the zipper slider and the handle while sliding the zipper slider in the closing direction; and (c) an alignment plate included on the body and positioned at an interlocking point of the zipper slider on the side of the zipper tracks opposite a zipper handle for providing sliding support to the zipper during pulling movement of the body for assisting and maintaining the device in alignment with the zipper tracks;

wherein the first and second diverging guide channels of the body of the device are spaced apart such that the first and second guide channels reduce the closure angle of the zipper tracks but do not bring the zipper tracks close enough together so that mating teeth of the zipper tracks are able to interlock.

2. The device according to claim 1, wherein the body is wedge shaped.

3. The device according to claim 1, wherein the first and second diverging guide channels define respective opposed concave surfaces with respect to a centerline of the body.

4. The device according to claim 1, wherein the body includes an opening that receives the handle carried by the body.

5. The device according to claim 1, wherein each guide channel further includes relatively narrow access slots formed in a periphery of each guide channel for receiving and retaining each zipper track within the respective guide channel.

6. The device according to claim 1, wherein each guide channel further includes a bevel at an end of each guide channel for providing ease of ingress and egress of each zipper track.

7. The device according to claim 1, wherein the body includes a notch having a shape that approximates the shape of the zipper slider for receiving the zipper slider therein.

8. The device according to claim 1, further including a zipper pull tab extension member generally coextensive with the handle and attached to the zipper pull tab.

9. The device according to claim 1, further including an arcuately shaped recess defined on a surface opposite a notch on the body for providing clearance for slideable movement about a patient's limb.

10. A device for assisting a zipper in selectively disconnecting and connecting a pair of opposed interlockable zipper tracks as the zipper moves in respective opening and closing directions along the zipper tracks, the device comprising:

(a) a body having first and second diverging guide channels for receiving the respective zipper tracks for sliding, non-interlocking movement of the zipper tracks through the guide channels in advance of the zipper slider for reducing a closure angle of the zipper tracks in advance of the zipper slider, the body further including an alignment plate positioned at an interlocking point of the zipper slider on the side of the zipper tracks opposite a zipper handle for providing sliding support to the zipper during pulling movement of the body for assisting and maintaining the device in alignment with the zipper tracks;

(b) a handle carried by the body for permitting manual pulling movement of the body along at least a portion of the length of the zipper; and (c) a notch formed in the body to approximate the shape of the zipper slider for receiving the zipper slider;

(d) wherein the handle is generally positioned in a coextensive orientation in relation to a pull tab of the zipper slider such that an operator can simultaneously grasp the pull tab of the zipper slider and the handle while sliding the zipper slider in the closing direction;

wherein the first and second diverging guide channels of the body of the device are spaced apart such that the first and second guide channels reduce the closure angle of the zipper tracks but do not bring the zipper tracks close enough together so that mating teeth of the zipper tracks are able to interlock.

11. The device according to claim 10, wherein the body is wedge shaped.

12. The device according to claim 10, wherein the first and second diverging guide channels define respective opposed concave surfaces with respect to a centerline of the body.

13. The device according to claim 10, wherein the body includes an opening that receives the handle carried by the body.

14. The device according to claim 10, wherein each guide channel further includes relatively narrow access slots formed in a periphery of each guide channel for receiving and retaining each zipper track within the respective guide channel.

15. The device according to claim 10, wherein each guide channel further includes a bevel at an end of each guide channel for providing ease of ingress and egress of each zipper track.

16. The device according to claim 10, further including a zipper pull tab extension member attached to the zipper pull tab and generally coextensive with the handle for extending the zipper pull tab.

17. The device according to claim 10, further including an arcuately shaped recess defined on a surface opposite the notch for providing clearance for slideable movement about a patient's limb.

* * * * *